US010475609B2

(12) United States Patent
Cacciatore et al.

(10) Patent No.: US 10,475,609 B2
(45) Date of Patent: Nov. 12, 2019

(54) DISCONNECTING DEVICE FOR A POWER LINE AND METHOD FOR DISCONNECTING A POWER LINE

(71) Applicant: Auto-Kabel Management GmbH, Hausen im Wiesental (DE)

(72) Inventors: David Cacciatore, Krefeld (DE); Wacim Tazarine, Erkelenz (DE); Sohejl Rafati, Moenchengladbach (DE)

(73) Assignee: Auto-Kabel Management GmbH, Wiesental (DE)

( * ) Notice: Subject to any disclaimer, the term of this patent is extended or adjusted under 35 U.S.C. 154(b) by 0 days.

(21) Appl. No.: 16/318,528

(22) PCT Filed: Apr. 18, 2017

(86) PCT No.: PCT/EP2017/059105
§ 371 (c)(1),
(2) Date: Jan. 17, 2019

(87) PCT Pub. No.: WO2018/015032
PCT Pub. Date: Jan. 25, 2018

(65) Prior Publication Data

US 2019/0244777 A1 Aug. 8, 2019

(30) Foreign Application Priority Data

Jul. 18, 2016 (DE) ..... 10 2016 113 156

(51) Int. Cl.
*H01H 39/00* (2006.01)

(52) U.S. Cl.
CPC ..... *H01H 39/00* (2013.01); *H01H 2039/008* (2013.01)

(58) Field of Classification Search
CPC ..... H01H 39/00; H01H 2039/008; H01H 2003/266; H01H 9/542; H01H 2003/543
See application file for complete search history.

(56) References Cited

U.S. PATENT DOCUMENTS 4,074,098 A 2/1978 Pullen
4,803,319 A 2/1989 Bernard et al.
(Continued)

FOREIGN PATENT DOCUMENTS

CN 1034633 A 8/1989
CN 101582345 A 11/2009
(Continued)

*Primary Examiner* — Kyung S Lee
(74) *Attorney, Agent, or Firm* — The Webb Law Firm

(57) ABSTRACT

Disconnecting device for a power line, having at least one disconnecting means which is spatially arranged between a first and a second connector when the disconnecting device is in a closed state, the disconnecting means having at least one connecting element forming an electrical connection between the connectors when the disconnecting device is in the closed state, wherein the connecting element is electrically connected to the first connector via a first contact point and to the second connector via a second contact point when the disconnecting device is in the closed state, and wherein the disconnecting means is arranged in such a way that a breakdown voltage between the first and the second connector when the disconnecting device is in an open state is greater than between the first connector and the first contact point of the connecting element and/or between the second connector and the second contact point of the connecting element.

13 Claims, 10 Drawing Sheets

(56) References Cited

U.S. PATENT DOCUMENTS

| | | | | |
|---|---|---|---|---|
| 5,581,192 | A * | 12/1996 | Shea | H01H 29/004 324/555 |
| 9,111,670 | B2 * | 8/2015 | Nayak | H01C 13/02 |
| 2012/0313560 | A1 * | 12/2012 | Hambitzer | H01M 10/4207 318/139 |
| 2013/0134028 | A1 | 5/2013 | Bohori et al. | |
| 2014/0131179 | A1 * | 5/2014 | Ho | H01H 19/11 200/11 R |
| 2016/0114695 | A1 * | 4/2016 | Holgers | H01M 2/206 701/22 |
| 2017/0148597 | A1 | 5/2017 | Mayer et al. | |

FOREIGN PATENT DOCUMENTS

| | | | |
|---|---|---|---|
| CN | 201780900 | U | 3/2011 |
| DE | 102012212509 | A1 | 1/2014 |
| DE | 102014109405 | A1 | 1/2016 |
| EP | 2600372 | A1 | 6/2013 |
| GB | 1499486 | A | 2/1978 |
| WO | 2016001380 | A1 | 1/2016 |

* cited by examiner

DISCONNECTING DEVICE FOR A POWER LINE AND METHOD FOR DISCONNECTING A POWER LINE

CROSS-REFERENCE TO RELATED APPLICATIONS

This application is the United States national phase of International Application No. PCT/EP2017/059105 filed Apr. 18, 2017, and claims priority to German Patent Application No. 10 2016 113 156.3 filed Jul. 18, 2016, the disclosures of which are hereby incorporated in their entirety by reference.

BACKGROUND OF THE INVENTION

Field of the Invention

The subject matter relates to a disconnecting device for a power line, in particular a motor vehicle power line, comprising at least one disconnecting means which is spatially arranged between a first and a second connector when the disconnecting device is in a closed state. Furthermore, the subject matter relates to a method for disconnecting a power line.

Description of Related Art

The electrical protection of power conductors, in particular motor vehicle power conductors, represents a safety-relevant area of motor vehicle technology with regard to ensuring the safety of the vehicle occupants. In particular motor vehicle power conductors which carry a high current, such as the starter and generator cables, the main battery line and/or additional current-carrying lines of the motor vehicle power supply, must be quickly disconnected from the vehicle battery in the event of accidents. If this is not ensured, short circuits with momentarily very high currents can occur in the event of accidents. The high short-circuit currents can lead to the formation of electric arcs. This must be reliably prevented so that the safety of the vehicle occupants is not at risk.

Nowadays, disconnecting devices in which the power lines are disconnected by pyrotechnic disconnecting devices when there is a threat of a short circuit are frequently used. The disconnection of the power lines by means of the pyrotechnic disconnecting devices is generally achieved either by mechanically cutting the power line or by accelerating a pin out of a cylinder, in the closed state, a current path being formed between the pin and the cylinder, which path is cut by the disconnecting device, e.g. the pin.

In the case of the pyrotechnic disconnecting devices which are conventionally used, it is disadvantageous that at the moment of the disconnection of a current-carrying line, electric arcs can form between the gap at the disconnecting point, as a result of which the connectors remain electrically interconnected at least temporarily. This is often the case in particular for high-voltage applications in electric or hybrid vehicles, since in this case, the formation of electric arcs is particularly favoured as a result of the high currents and differences in potential.

SUMMARY OF THE INVENTION

For these reasons, the problem addressed by the subject matter is that of providing a disconnecting device for power lines which ensures safe disconnection of current-carrying lines even in high-voltage applications.

This problem is solved in terms of subject matter by a disconnecting device for a power line, having at least one disconnecting means which is spatially arranged between a first and a second connector when the disconnecting device is in a closed state, the disconnecting means comprising at least one connecting element forming an electrical connection between the connectors when the disconnecting device is in the closed state, wherein the connecting element is electrically connected to the first connector via a first contact point and to the second connector via a second contact point when the disconnecting device is in the closed state, and wherein the disconnecting means is arranged in such a way that a breakdown voltage between the first and the second connector when the disconnecting device is in an open state is greater than between the first connector and the first contact point of the connecting element and/or between the second connector and the second contact point of the connecting element.

In this case, the disconnecting device can be designed in such a way that the first and second connectors are current-carrying components of a motor vehicle power line. Likewise, the first and second connectors can also be current-carrying components of power lines of other vehicles, of building installations, of electrically operated machines or signal boxes. In particular in locations where high currents are flowing, it is expedient to provide concrete protection of the electric circuits. Advantageously, for this purpose, the disconnecting device in the closed state has a current load capacity of more than 10 ampere, preferably of more than 20 ampere, in particular of more than 100 ampere.

Likewise, wherever there are relatively high voltages, it is expedient to provide concrete protection of the electric circuits. To ensure safe disconnection for example even of lines in high-voltage power supplies, the disconnecting device is advantageously formed in such a way that there is a difference in potential of at least 100 V, preferably of at least 200 V, in particular of more than 200 V between the connectors in the open state.

To achieve the most loss-free power supply possible in a closed state of the disconnecting device, the connecting element and the connectors can be formed preferably from an electrically conductive material, such as a copper material or an aluminium material. In this case, the connectors and the connecting element can also be formed from different materials. Advantageously, the material of the connecting element or the connectors can be adapted to the requirements in each case. A copper material is preferably used in the region of the power transmission where only a limited installation space is available and, at the same time, there are high operating temperatures and high mechanical requirements placed on the material. An aluminium material is used in the region of the power transmission wherever weight or costs are to be saved.

The connecting element can preferably be in the form of a flat cable. It is understood that, according to another embodiment, round cables can equally be used instead of flat cables. At the same time, a combination of round and flat cables can also be provided. The cables can be formed from solid material.

It has been recognised that when disconnecting current-carrying lines, it is possible to reduce, in an extremely efficient manner, the probability of electric arcs being formed if a current-carrying line is disconnected substantially simultaneously not only at one, but at two disconnecting points. The induced voltage is thereby divided between both disconnecting points, as a result of which the voltage to be disconnected is divided between the two disconnecting points.

To ensure the most efficient possible reduction in the probability of electric arcs being formed, it is therefore proposed that the connecting element can be arranged on the disconnecting means in such a way that a disconnection takes place at at least two contact points at substantially the same time.

For this purpose, it is proposed that the connecting element can be connected to the disconnecting means at least in an interlocking manner, for example as a tongue-and-groove or dovetail connection. Preferably, the connecting element can be connected to the disconnecting means with a force fit, for example in a wedged or screwed manner. Particularly preferably, the connecting element can be connected to the disconnecting means in an integrally bonded manner, in particular soldered, bonded or welded.

To ensure the most simultaneous possible disconnection of the connectors from the connecting element, it is proposed that the disconnecting device can preferably be formed in such a way that the disconnecting means can be moved translationally and/or rotationally between an open and a closed state of the disconnecting device. In this case, the shape of the disconnecting means can advantageously be adapted to the manner of the disconnection. Thus, during a disconnection of the connectors from a connecting element as a result of a rotation of the disconnecting means, the disconnecting means can be formed to be substantially circular, whereas during a disconnection of the connectors from a connecting element as a result of a translational movement of the disconnecting element, the disconnecting means can be formed to be substantially polygonal, in particular square. As a result, depending on the type of movement of the disconnecting element, in particular the process of disconnecting the connecting element from the connectors is facilitated. Rhombus, trapezoidal, elliptical or other geometric shapes are also possible for the disconnecting element.

By means of a translational or rotational movement of the disconnecting element and the preferably loss-preventing arrangement of the connecting element on the disconnecting means, a substantially simultaneous disconnection of the connecting element from both connectors and thus a reduction in the probability of electric arcs being formed during the disconnection of a current-carrying line can be achieved.

To ensure a simple and simultaneously safe initiation of a disconnecting process, it is proposed that the disconnecting device can be in the form of a pyrotechnic disconnecting device. In this case, the disconnection can be initiated preferably by igniting an ignition squib in an ignition channel. In one embodiment, the ignition channel can be arranged with a disconnecting means on for example a connection lug which is rigidly connected to the disconnecting means at the same time and holds said means in a fixed position.

As a result of the pulse caused by the ignition of the ignition squib, the connection between the ignition channel and the connection lug can be disconnected. As a result of the disconnection, the disconnecting means can no longer be held in the position thereof, whereupon said means rotates about its own axis together with the connecting element and disconnects the connecting element from the first and second connectors at a first and second contact point.

In one embodiment of a disconnecting device having a disconnecting element, the ignition channel can likewise also be arranged on a piston which, as a result of the pulse caused by the ignition of the ignition squib, is accelerated away from the ignition channel in such a way that the disconnecting means undergoes a translational movement at an angle, preferably perpendicularly to the connection plane of the connectors and of the connecting element, which movement leads to a disconnection of the connection between the ignition channel and the connection lug.

Alternatively to the disconnection by a pyrotechnic disconnecting means, the disconnection of the connectors from the connecting element can likewise take place by means of a compressed-air disconnecting means, a motor-controlled disconnecting means, a hydraulically controlled disconnecting means or a magnetically controlled disconnecting means.

Additionally, as an alternative to a disconnection by a movement of the disconnecting means, a disconnection can also take place by means of the acceleration of two disconnecting bits which are accelerated substantially at the same time towards the contact points between the connectors and the connecting element and disconnect the connectors from the connecting element at said points.

In order to ensure greater flexibility with regard to the displacement path of the disconnecting means of the disconnecting device which is the subject matter, it is proposed that the disconnecting device is formed in such a way that, in a final state of the disconnecting device, the disconnecting means is arranged in such a way that the breakdown voltage between the first and the second connector is the same as or less than between the first connector and the first contact point of the connecting element and/or between the second connector and the second contact point of the connecting element.

In the case of a round, preferably circular disconnecting means, this can be achieved for example in that the disconnecting means of the disconnecting device is rotated out of the original position by an angle of 45° or more during the disconnection. Alternatively, in the case of an angular-shaped disconnecting means, this can be achieved in that the route of a translational movement carried out during the disconnection is greater than or the same as the distance between the two connectors in the open state of the disconnecting device.

In order to prevent the formation of an electric arc as efficiently as possible, it is proposed that the disconnecting means can comprise at least one isolation element which is spatially arranged between the first and the second connector when the disconnecting device is in an open state. In this case, the isolation element can be connected to the disconnecting means in an interlocking manner, preferably with a force fit, particularly preferably in an integrally bonded manner.

In one embodiment of the disconnecting device having a round, preferably circular disconnecting means, the isolation element can preferably be formed to be partly circular—and in a closed state of the disconnecting device can be arranged directly on the connecting element. In particular in the case of such an embodiment, the disconnecting means can comprise at least two isolation elements which are spatially arranged between a first and a second connector in a closed state of the disconnecting device. This ensures that an electric arc is extinguished as quickly as possible at both disconnecting points after a disconnection of the connecting element from the connectors.

In one embodiment of the disconnecting device having an angular disconnecting means, preferably only one isolation element, which is advantageously formed to be rectangular, can be arranged directly on the connecting element in a closed state of the disconnecting device.

A particularly simple manner of arranging an isolation element at or on a disconnecting means can be achieved in that the disconnecting means is preferably formed completely from an isolation material. In this case, the disconnecting means can have only one groove or recess for receiving the connecting element and otherwise can be formed completely from an isolation material.

In order to ensure that an electric arc is extinguished sufficiently quickly and safely after the disconnection of a current-carrying line, it is proposed that the isolation element can be formed from a breakdown-resistant isolation element having a low electric conductivity, preferably a plastics material, a ceramic or a resin. In this case, the isolation element can preferably be formed from an isolation material having a breakdown resistance of at least more than 5 kV/mm, preferably more than 20 kV/mm, particularly preferably more than 50 kV/mm and/or a specific electric conductivity of at least less than $10^{-5}$ S·cm−1, preferably less than $10^{-10}$ S·cm−1, particularly preferably less than $10^{-15}$ S·cm−1.

According to one embodiment, it is proposed that the disconnecting device can comprise at least one resistor element which, immediately after the disconnection, is arranged between the connectors, thereby electrically connecting the connectors. In this case, the resistor element can be connected to the disconnecting means in an interlocking manner, preferably with a force fit, particularly preferably in an integrally bonded manner.

It has been recognised that the probability of electric arcs being formed during the disconnection of current-carrying lines can be significantly reduced if the connectors initially remain interconnected in an electrically conductive manner by at least one resistor element immediately after the disconnection, and the current is thereby initially reduced, to ultimately actually be completely disconnected. The current flow between the connectors is firstly merely limited before at least one isolation element which is spatially arranged between the first and the second connector substantially completely prevents the current flow for the purpose of complete disconnection. This arrangement corresponds to two-stage switching and reduces the risk of an electric arc being formed in that, in addition to a reduced induction voltage, the change in current over time (di/dt) in each case is reduced.

In order to reduce a current flow between the connectors as efficiently as possible, it is proposed that the resistor element can be formed from a material having a low specific electric conductivity of at least less than $10^{2}$ S·cm$^{-1}$, preferably less than $10^{-1}$ S·cm$^{-1}$, particularly preferably less than $10^{-4}$ S·cm$^{-1}$.

In one embodiment of the disconnecting device having a round, preferably circular disconnecting means, the resistor element can preferably be formed to be partly circular—and in a closed state of the disconnecting device can be arranged directly on the connecting element. In particular in the case of such an embodiment, the disconnecting means can comprise at least two resistor elements which are spatially arranged between a first and a second connector in a closed state of the disconnecting device. This ensures that the current flow is reduced as quickly as possible at the disconnecting points after a disconnection of the connecting element from the connectors.

In one embodiment of the disconnecting device comprising an angular disconnecting means, also only one resistor element, which is advantageously formed to be rectangular, can be arranged, and can be arranged directly on the connecting element in a closed state of the disconnecting device.

According to one embodiment, it is proposed that the disconnecting device can comprise at least two resistor elements which can preferably be formed from different materials having a different specific electric conductivity.

Preferably, in this case, immediately after a disconnection, the resistor elements can be arranged between the connectors in such a way that a change in current over time (di/dt) as a result of the disconnection of a current-carrying line is as small as possible.

In the case of an embodiment of the disconnecting device having a circular disconnecting means, this can be achieved for example in that two resistor elements which are formed to be partly circular and differ in terms of the specific electric conductivity thereof are arranged on the disconnecting means in such a way that, after the disconnection of an electrical connection between the connectors and the connecting element as a result of a rotation of the disconnecting means, an electrical connection is produced between the connectors by means of the two resistor elements, wherein the two resistor elements form a resistance gradient along the direction of movement of the disconnecting means so that as the angle of rotation increases, the electrical resistance between the connectors increases.

In the case of an embodiment of the disconnecting device having a rectangular disconnecting means, two resistor elements having a different specific electric conductivity can preferably be arranged in such a way that the resistor element having the higher specific electric conductivity is firstly arranged between the first and second connectors after a disconnection of the disconnecting device, before the resistor element having the lower specific electric conductivity is then arranged between the connectors. Also as a result, a resistance gradient is achieved in the direction of movement of the disconnecting means.

According to one embodiment, it is proposed that more than two resistor elements, which differ in terms of the specific electric conductivity thereof, are arranged on or at the disconnecting means, preferably in the form of a coating having a resistance material which forms a resistance gradient. This allows a disconnection of a current-carrying line having a resistance increasing in the direction of movement and thereby considerably reduces the current gradient and thus the probability of an electric arc being formed during the disconnection of a current-carrying line.

According to another embodiment, it is proposed that the disconnecting device comprises at least two disconnecting means electrically connected in series, the disconnecting means, which are spatially separated from one another, preferably being interconnected by connecting means.

The principle of minimising the probability of an electric arc being formed during the disconnection of a current-carrying line can be further optimised in that, by increasing the number of disconnecting points—provided that the disconnecting points are opened at substantially the same time—the voltage induced by the change in current is divided between a plurality of disconnecting points.

According to another embodiment, it is proposed that, in a parallel arrangement, a first and second connector, in the closed state of the disconnecting device, are electrically interconnected by means of two connecting elements at a first and second contact point and a third and fourth contact point—and as a result of a rotational or translational movement of the disconnecting means, can be disconnected from one another at substantially the same time.

As a result, the principle of minimising the probability of an electric arc being formed during the disconnection of a current-carrying line can be further optimised, since by means of the parallel arrangement of two connecting elements, and two disconnecting points arranged in parallel being opened at substantially the same time, not only the induced voltage, but also the current flow in each of the disconnecting points is halved in comparison with only one disconnecting point.

It is understood that all the embodiments and examples of a series arrangement of a disconnecting device are equally transferable to a parallel arrangement of a disconnecting device. Accordingly, the probability of an electric arc being formed during the disconnection of a current-carrying line can also be further reduced in the parallel embodiment by the additional integration of resistor elements in the form of a resistance gradient.

In order to ensure electrical isolation, it is proposed that the disconnecting device can be arranged in a housing. It can thus be achieved that, during a disconnection of a current-carrying line, despite the formation of an electric arc, no flashover to the environment takes place.

In this case, the housing can preferably be formed from a breakdown-resistant material having a low specific electric conductivity, in particular a plastics material, a ceramic or a resin.

A further subject matter is a method for disconnecting a power line, in which at least one disconnecting signal is received, before at least one signal, in particular a control signal for igniting an ignition squib is triggered in such a way that the electrical connection between a connecting element arranged on a disconnecting means and a first connector at a first contact point and between the connecting element and a second connector at a second contact point is disconnected in such a way that a breakdown voltage between the first and the second connector in the disconnected state of the disconnecting device is greater than between the first connector and the first contact point of the connecting element and/or between the second connector and the second contact point of the connecting element.

The method for disconnecting a power line can preferably be designed in such a way that a disconnection of the disconnecting means takes place at at least two contact points at substantially the same time.

In order to protect the vehicle occupants of a motor vehicle from a short circuit of a current-carrying line in a reliable and simultaneously simple manner in the event of an accident, the method for disconnecting a power line, in particular the disconnecting signal, can preferably be coupled to the triggering of an air-bag control signal.

Alternatively or in addition to the coupling of the method of the subject matter to an air-bag control signal, the method can also be coupled to the behaviour of other vehicle components, such as to the behaviour of the seatbelt pretensioner, the seatbelt force limiter or the roll-over bar.

In particular, the method of the subject matter can also be coupled to signals of crash or impact sensors.

According to one embodiment, it is proposed that the disconnecting signal is received from a sensor, preferably a reed sensor, a Hall sensor or an induction sensor.

To be able to transmit the disconnecting signal safely and without interference, the disconnecting signal can be transmitted preferably galvanically from the electric circuit. This can be achieved in particular in that the sensor is arranged in an electrically isolated manner for example on a housing of the disconnecting device.

According to another embodiment, a method for disconnecting a power line is proposed in which, in addition to the disconnection of an electrical connection, in particular at substantially the same time as the disconnection of an electrical connection, an electrical connection is produced which makes it possible to discharge stored electrical energy, in particular to discharge an intermediate circuit voltage from an intermediate circuit capacitor.

It has been recognised that, in particular when disconnecting current-carrying lines of the high-voltage power supplies of electric or hybrid vehicles which comprise intermediate electric circuits having intermediate circuit capacitors, it must be ensured that these electric circuits are also discharged during a disconnection of the current-carrying lines to prevent people from being at risk as a result of high voltage.

BRIEF DESCRIPTION OF THE DRAWINGS

The subject matter is explained in more detail below with reference to a drawing showing embodiments, in which.

DESCRIPTION OF THE INVENTION

Figure 1A:
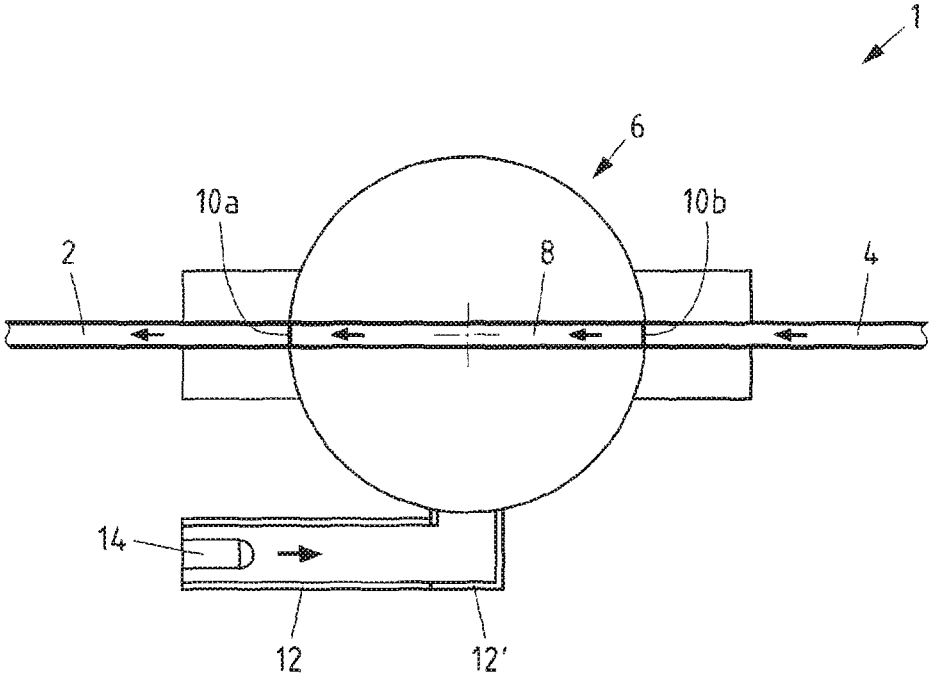
FIG. 1*a* shows a disconnecting device for a power line according to a first embodiment in a closed state.

Wherever possible, the same reference signs have been used for like elements in the drawings.

FIG. 1*a* shows a disconnecting device for a power line 1 in a closed state. In this state, a first connector 2 and a second connector 4 are electrically interconnected by means of a connecting element 8 at a first and a second contact point 10*a*, 10*b*. The connecting element 8 is arranged on or at a disconnecting means 6. A connection lug 12' is fastened to the disconnecting means 6, which lug is arranged on an ignition channel 12 comprising an ignition squib 14.

The connecting element 8 and the connectors 2, 4 can be formed preferably from an electrically conductive material, such as a copper material or an aluminium material. In this case, the connectors 2, 4 and the connecting element 8 can also be formed from different materials.

The connecting element 8 can preferably be in the form of a flat cable. It is understood that, according to another variant, round cables can equally be used instead of flat cables. At the same time, a combination of round and flat cables can also be provided. The connecting element 8 can preferably be arranged on the disconnecting means 6. The connecting element 8 is preferably a metal conducting path which is preferably arranged in a groove or recess in the disconnecting means 6.

As shown in FIG. 1*a*, the disconnecting means 6 is a circular component which can preferably be rotatably mounted. Advantageously, the disconnecting means 6 can be formed from an electrical isolator, preferably a plastics material or a ceramic. In this case, the disconnecting means 6 can comprise in particular groove-shaped or partly circular recesses into which the connecting element 8 can be inserted. Thus, in a closed state of the disconnecting device 1, for example an electrical connection between a first and a second connector 2, 4 can be produced by means of the connecting element 8.

The contact points 10*a*, 10*b* can advantageously be in the form of predetermined breaking points comprising taperings of material. For this purpose, in the closed state of the disconnecting device 1, for example the material cross sections in the corresponding contact regions 10*a*, 10*b* between the connectors 2, 4 and the connecting element can be smaller than at the connectors 2, 4 and/or the connecting element 8. Preferably, the contact regions 10*a*, 10*b* can also be formed from a material which firstly has a low material strength, and secondly has a high current load capacity.

The connection lug 12' attached to the ignition channel 12 can also comprise a predetermined breaking point which can preferably be arranged at the contact point between the connection lug 12' and ignition channel 12.

Figure 1B:
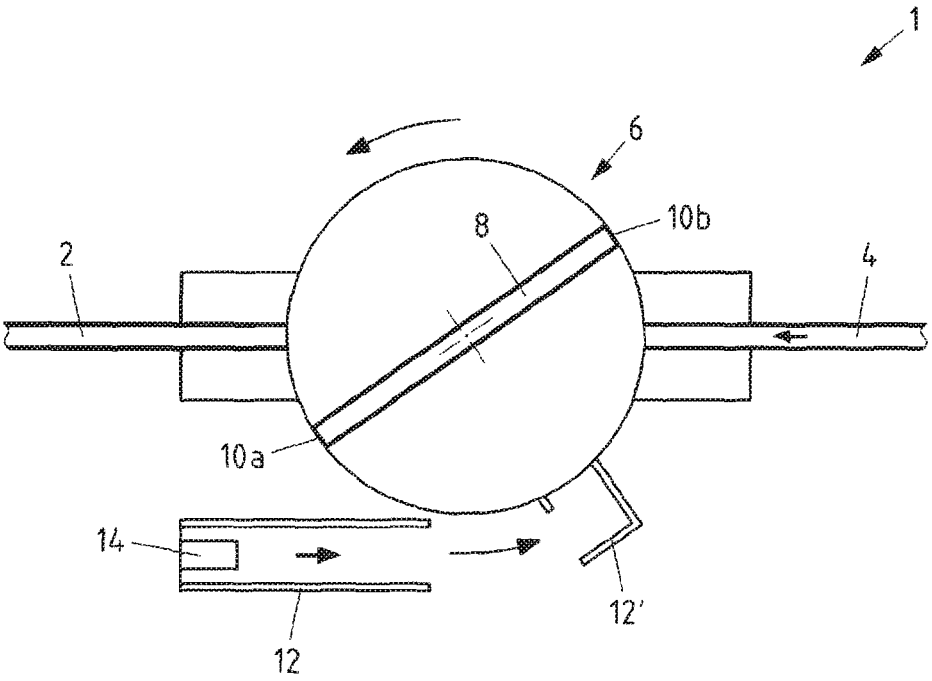
FIG. 1*b* shows the disconnecting device according to FIG. 1*a* in an open state.

FIG. 1*b* shows the disconnecting device for a power line 1 from FIG. 1*a* in an open state. In this case, the two connectors 2, 4 are now no longer interconnected by means of the connecting element 8, but rather are electrically disconnected from one another as a result of a rotation of the disconnecting means 6. From FIG. 1*b*, it can be seen that the connection lug 12' was disconnected from the ignition channel 12 by the triggering of the ignition squib 14, and the disconnecting means 6 could thus no longer be held in the original position thereof. By means of the rotation shown of the disconnecting means 6 by an angle of approx. 20-25° anticlockwise, the connecting element 8 was disconnected from the first and second connectors 2, 4 at the first and second contact points 10*a*, 10*b*. It is understood that, according to another variant, instead of an anticlockwise rotation, a rotation can also take place clockwise.

By means of the embodiment shown in FIG. 1*a, b*, it is possible to disconnect, substantially simultaneously, the current path at two different contact points 10*a*, 10*b* which are arranged at a distance from one another, as a result of which the induced voltage is divided between both disconnecting points. Consequently, the probability of electric arcs being formed is considerably reduced.

Figure 1C:
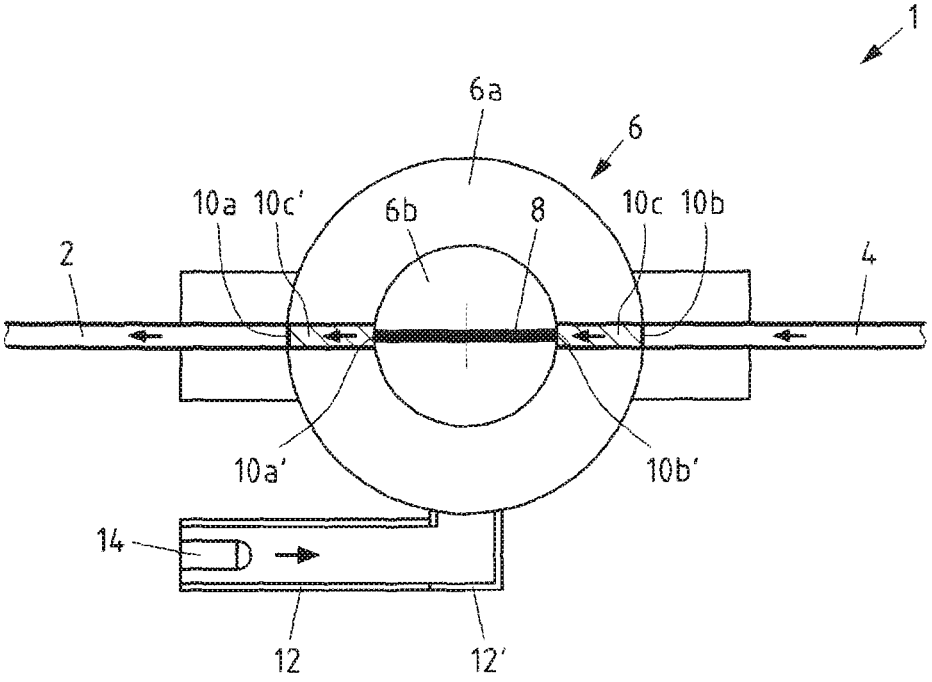
FIG. 1*c* shows a disconnecting device for a power line according to a first embodiment having a two-part disconnecting means in a closed state.

FIG. 1*c* shows a disconnecting device for a power line 1 having a two-part disconnecting means 6 in a closed state. In this state, a first connector 2 and a second connector 4 are electrically interconnected by means of a connecting element 8 and two other connecting pieces 10*c*, 10*c'*. The connecting pieces 10*c*, 10*c'* are arranged in each case on the first disconnecting means portion 6*a* of the disconnecting means 6 and are electrically connected to the first and the second connector 2, 4 respectively at a first contact point 10*a* and 10*b* respectively. Furthermore, the connecting pieces 10*c*, 10*c'* are electrically connected to the connecting element 8 at a second contact point 10*a'* and 10*b'* respectively, which connecting element is arranged on the second disconnecting means portion 6*b* of the disconnecting means 6. According to the arrangement of the disconnecting device according to FIG. 1*a, b*, in the configuration having two-part disconnecting means, a connection lug 12' is additionally provided, which lug is fastened firstly to an ignition channel 12 comprising an ignition squib 14 and secondly to the disconnecting means portion 6*a* of the disconnecting means 6.

Figure 1D:
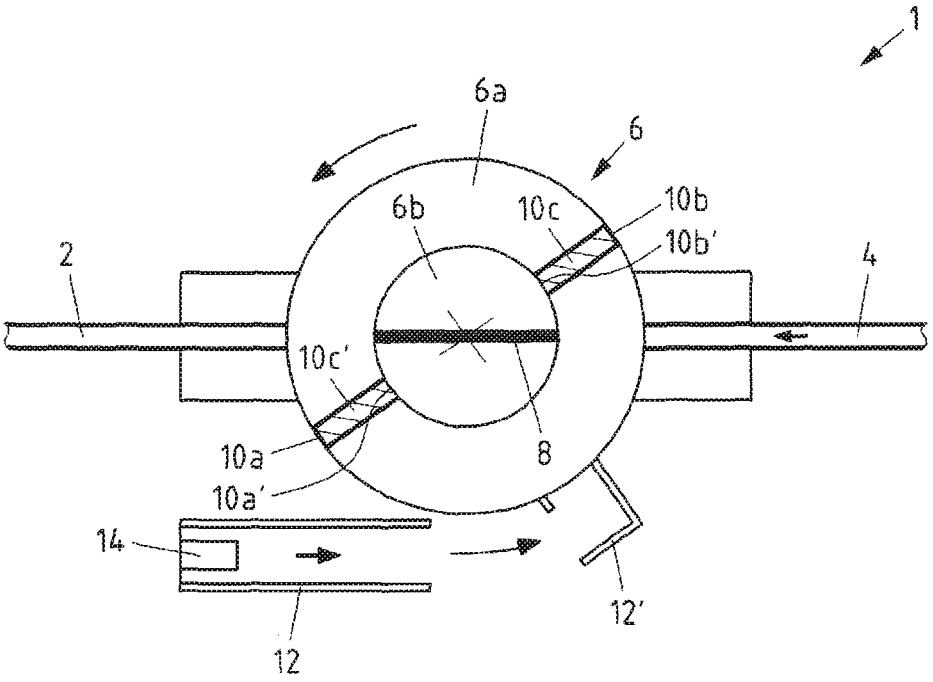
FIG. 1*d* shows the disconnecting device according to FIG. 1*c* in an open state.

FIG. 1*d* shows the disconnecting device for a power line 1 from FIG. 1*c* in an open state. In this case, the two connectors 2, 4 are now no longer electrically interconnected by means of the connecting element 8 and the two connecting pieces 10*c*, 10*c'*, but rather are electrically disconnected from one another as a result of a rotation of the first disconnecting means portion 6*a*. From FIG. 1*d*, it can be seen that the connection lug 12' was also disconnected from the ignition channel 12 in the configuration having two-part disconnecting means by the triggering of the ignition squib 14. In contrast with the disconnecting device comprising one-piece disconnecting means according to FIG. 1*a, b*, however, in this case, only the position of the first disconnecting means portion 6*a*, and not the position of the entire disconnecting means 6 changes. As a result of the triggering of the ignition squib, the rotation shown of the first disconnecting means 6*a* by an angle of approx. 20-25° is caused, by means of which the connecting pieces 10*c*, 10*c'* are disconnected between the first connector 2 and the connecting element 8 at the contact points 10*a* and 10*a'*, and the second connector and the connecting element 8 at the contact points 10*b* and 10*b'*.

Figure 2A:
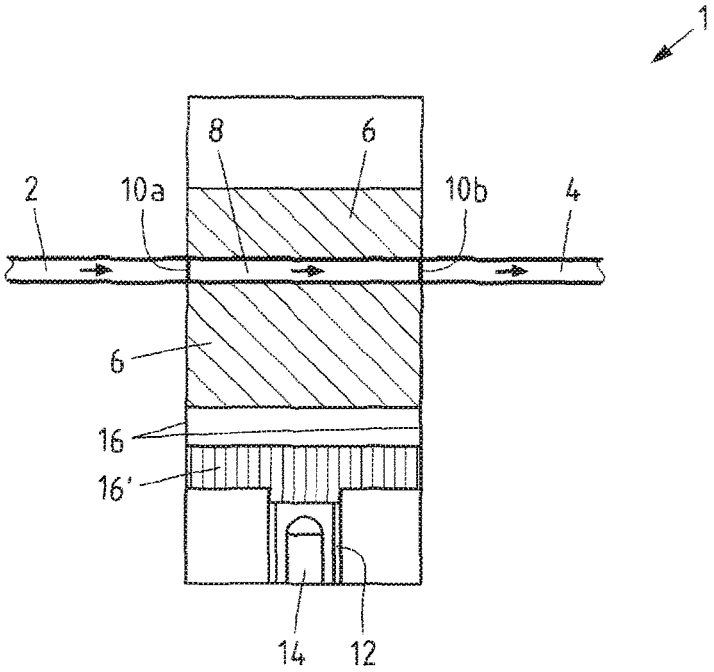
FIG. 2*a* shows a disconnecting device for a power line according to a second embodiment in a closed state.

By means of the embodiment shown in FIG. 1*c, d*, it is possible to disconnect, substantially simultaneously, the current path not only at two, but at four different contact points 10*a*, 10*a*', 10*b*, 10W which are arranged at a distance from one another, as a result of which the induced voltage is divided between not only two, but four disconnecting points. Consequently, the probability of electric arcs being formed is further reduced in comparison with the disconnecting device comprising one-piece disconnecting means according to FIG. 1*a, b*. FIG. 2*a* shows a disconnecting device for a power line 1 according to a second embodiment in a closed state. In this case as well, a first connector 2 and a second connector 4 are electrically interconnected by means of a connecting element 8 at a first and a second contact point 10*a*, 10*b*. In contrast with the embodiment according to FIG. 1*a, b*, the disconnecting means 6 on which the connecting element 8 is arranged is formed to be rectangular. Also according to the embodiment from FIG. 2*a, b*, an ignition squib 14 is arranged in an ignition channel 12, but, unlike as proposed in FIG. 1*a, b*, a connection lug is not fastened to the ignition channel 12, but rather a pin 16' is arranged on the ignition channel 12.

As shown in FIG. 2, the disconnecting means 6 and the pin 16' can be held in the position thereof by a lateral delimitation 16 in order to prevent movement of the pin 16' and the disconnecting means 6 substantially perpendicularly to the main direction of movement.

Figure 2B:
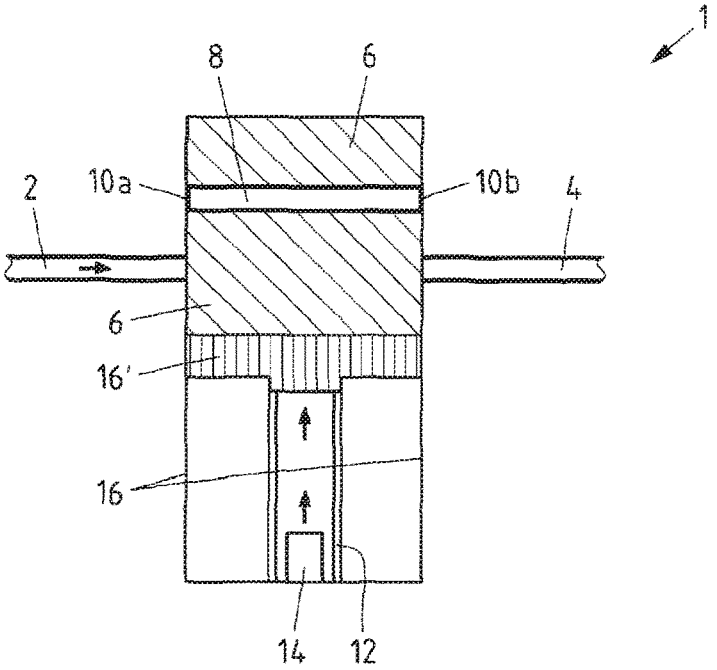
FIG. 2*b* shows the disconnecting device according to FIG. 2*a* in an open state.

The main direction of movement of the pin 16' can be seen from FIG. 2*b*, which shows the disconnecting device for a power line 1 from FIG. 2*a* in an open state. In this case, the two connectors 2, 4 are now no longer interconnected by means of the connecting element 8, but rather are disconnected from one another as a result of a movement of the disconnecting means 6 in an angular manner, preferably perpendicularly to the connection axis of the connectors and the connecting element 8. From FIG. 2*b*, it can be seen that the pin 16' is accelerated away from the ignition channel 12 by the triggering of the ignition squib 14 and displaces the disconnecting means 6 out of the original position thereof. By means of the translational movement shown of the disconnecting means 6, the connecting element 8 was disconnected from the first and second connectors 2, 4 at the first and second contact points 10*a*, 10*b*. Also in this case, the disconnection of the current path takes place at substantially the same time.

Figure 3A:
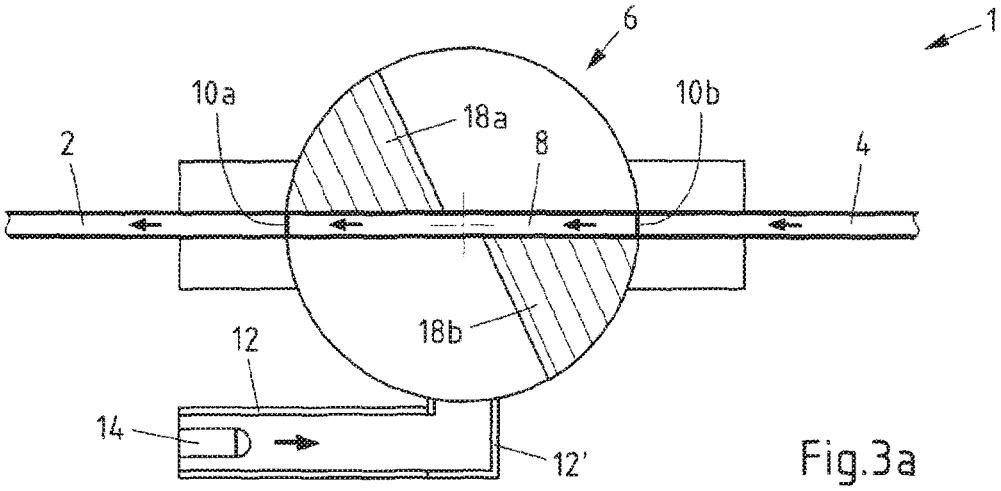
FIG. 3*a* shows a disconnecting device for a power line in a two-stage configuration according to a first embodiment in a closed state.
Figure 3B:
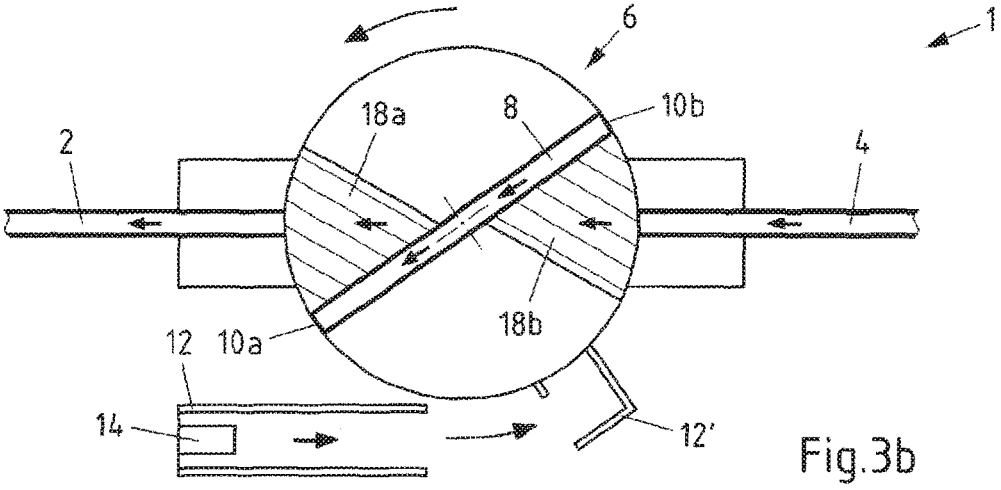
FIG. 3*b* shows the disconnecting device according to FIG. 3*a* in a state immediately after the disconnection.
Figure 3C:
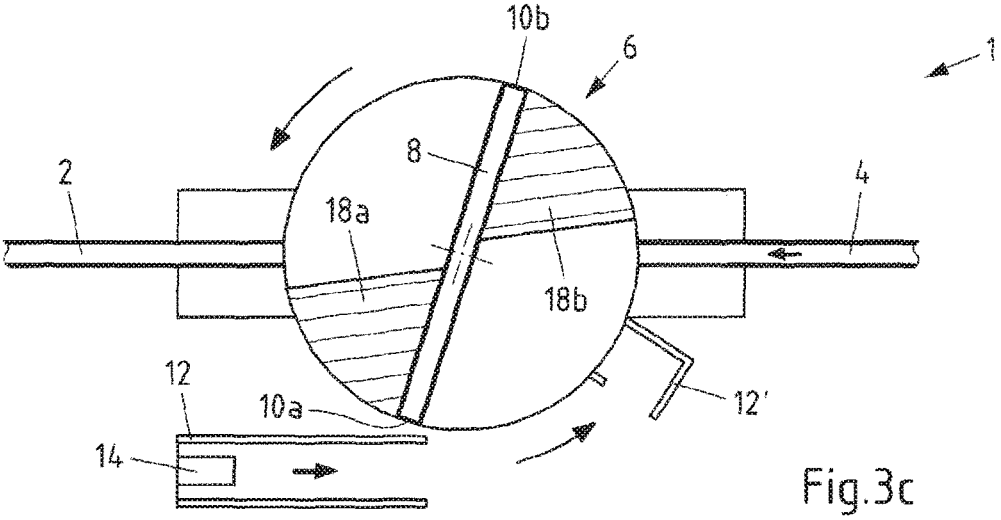
FIG. 3*c* shows the disconnecting device according to FIG. 3*a, b* in an open state.

FIG. 3*a-c* show another embodiment of a disconnecting device for a power line 1 comprising a two-stage switching mechanism.

In this case, FIG. 3*a* shows the structure already shown in FIG. 1*a* having a rotatable disconnecting element 6, in which a first and second connector 2, 4 are electrically interconnected by means of a connecting element 8. However, one difference is that the disconnecting means 6 according to the configuration from FIG. 3*a* comprises at least two resistor elements 18*a, b* which are arranged in a partly circular shape on the disconnecting means 6.

The resistor elements can preferably be formed from a material having a low specific electric conductivity of less than $10^2$ S·cm$^{-1}$, preferably less than $10^{-1}$ S·cm$^{-1}$, particularly preferably less than $10^{-4}$ S·cm$^{-1}$. The resistor elements can be connected to the disconnecting means 6, in particular soldered, bonded or welded. Likewise, the resistor elements can also be connected to the disconnecting means 6 in an interlocking manner, in particular as a tongue-and-groove or dovetail connection. More than only two resistor elements can also be arranged on the disconnecting means 6, which elements can preferably be formed from different materials having different specific electric conductivity in each case.

FIG. 3*b* shows an intermediate form between a closed state of the disconnecting device 1 according to FIG. 3*a* and an open state according to FIG. 3*c* immediately after the disconnection of the connectors 2, 4 from the connecting element 8. In this case, the two connectors 2, 4 are now no longer electrically interconnected by means of the connecting element 8, but rather are now electrically interconnected at least in part by means of the resistor elements 18*a, b* as a result of a rotation of the disconnecting means 6. The rotation of the disconnecting means 6 takes place—as can be seen from FIG. 3*b*—as a result of the triggering of an ignition squib 14 and the related disconnection of the connection lug 12' from the ignition channel 12. As a result of the rotation shown of the disconnecting means 6 by an angle of approx. 10-15° anticlockwise, the connecting element 8 was disconnected from the first and second connectors 2, 4 at the first and second contact points 10*a*, 10*b*, wherein in this case, however, an electrical connection is further formed between the first and second connectors at least in part by means of the resistor elements 18*a, b*.

As already mentioned, more than only two resistor elements 18*a, b* can also be arranged on the disconnecting means 6 which can preferably be formed from different materials having different specific electric conductivities in each case. It has been recognised that the formation of an electric arc during the disconnection of a current-carrying line can be prevented as efficiently as possible in that resistor elements are arranged on the disconnecting means 6 forming a resistance gradient in the direction of movement. By means of this type of the arrangement, instead of an abrupt disconnection of a power line, a more gentle disconnection of a power line can be achieved in which there is a lower current gradient, which counteracts the formation of electric arcs.

In this case, the two partly circular regions from FIG. 3*a-c* can be formed for example in each case from three different resistor elements which are arranged in such a way that the two resistor elements with the highest specific electric conductivity of all the six resistor elements in each case are arranged first of all at least in part between the two connectors as a result of a rotation of the disconnecting means 6 immediately after a disconnection of the disconnecting device 1. In the case of a further rotation or the continuation of a rotation, for example the two resistor elements having the next greatest specific electric conductivity in each case can subsequently be arranged at least in part between the two connectors. Lastly, during a last rotation or the further continuation of a rotation, for example in each case the two resistor elements having the lowest specific electric conductivity can lastly be arranged at least in part between the two connectors.

FIG. 3*c* shows the disconnecting device for a power line 1 according to FIG. 3*a, b* according to a further or the continuation of a rotation by an angle of a further approx. 10-15° in an open state in which the two connectors 2, 4 are now not electrically interconnected either by means of the connecting element 8 or at least in part by means of the resistor elements 18*a, b*.

By means of the embodiment shown in FIG. 3*a-c*, by generating a lower current gradient by using resistor elements, it is possible to further reduce the probability of electric arcs being formed by comparison with the embodiment according to FIG. 1*a, b*.

Figure 4A:
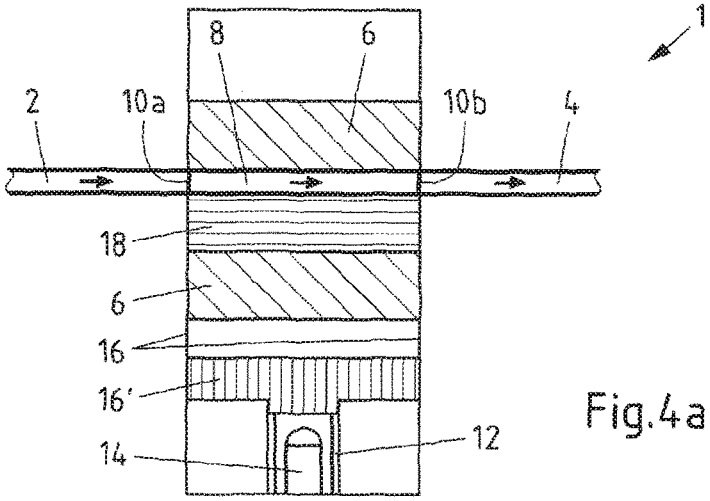
FIG. 4*a* shows a disconnecting device for a power line in a two-stage configuration according to a second embodiment in a closed state.
Figure 4B:
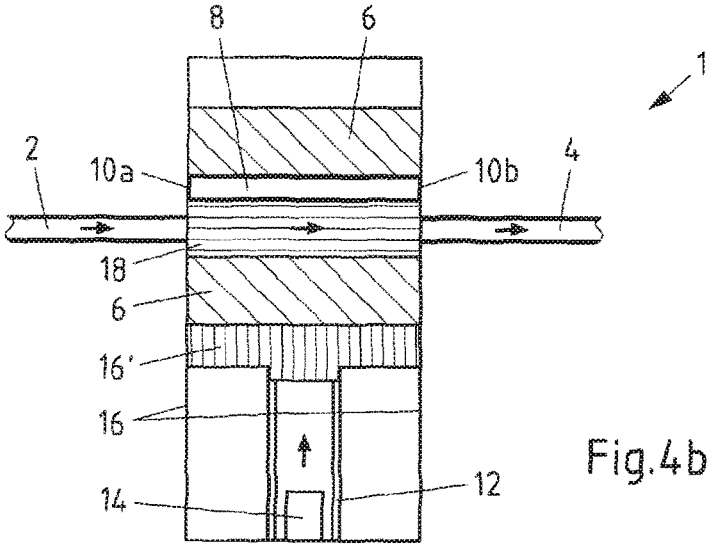
FIG. 4*b* shows the disconnecting device according to FIG. 4*a* in a state immediately after the disconnection.
Figure 4C:
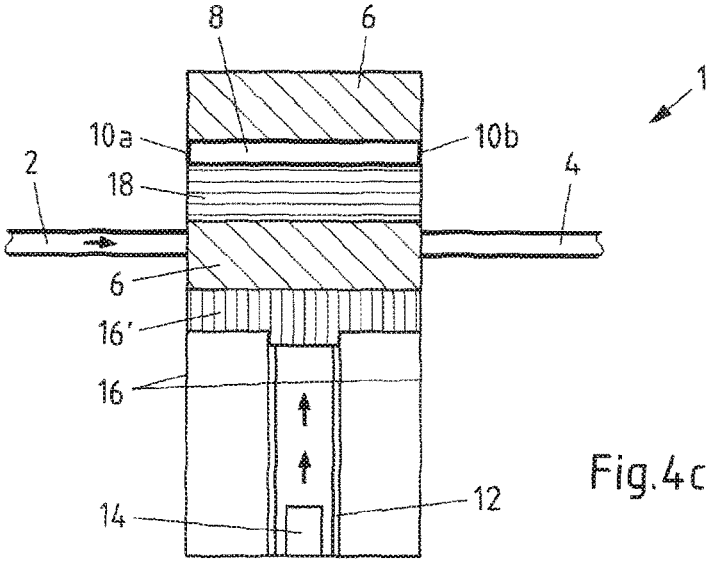
FIG. 4*c* shows the disconnecting device according to FIG. 4*a, b* in an open state.

FIG. 4*a-c* show a second embodiment of a disconnecting device for a power line 1 having an at least two-stage switching mechanism. In this case, FIG. 4*a* shows the structure already shown in FIG. 2*a* having a rectangular disconnecting means 6, in which a first and second connector 2, 4 are electrically interconnected by means of a connecting element 8. However, one difference is that the disconnecting means 6 according to the configuration from FIG. 4*a* comprises a resistor element 18 which is arranged on or at the disconnecting means 6.

FIG. 4*b* shows a state between a closed state of the disconnecting device 1 according to FIG. 4*a* and an open state according to FIG. 4*c* immediately after the disconnection of the connectors 2, 4 from the connecting element 8. In this case, the two connectors 2, 4 are now no longer electrically interconnected by means of the connecting element 8, but rather are electrically interconnected by means of the resistor element 18 as a result of a translational movement of the disconnecting means 6. The translational movement of the disconnecting means 6 perpendicularly to the connection axis of the connectors and the connecting element takes place—as can be seen from FIG. 4*b*—by the triggering of an ignition squib 14 and the related acceleration of the pin 16' away from the ignition channel 12.

It is understood that in the embodiment according to FIG. 4*a-c*, more than only one resistor element can also be arranged on the disconnecting means 6, which elements can preferably formed from different materials having a different specific electric conductivity in each case. Thus, in this embodiment, an arrangement is also possible which further reduces the probability of electric arcs being formed by a reduction of the current gradient.

FIG. 4*c* shows the disconnecting device for a power line 1 according to FIG. 4*a, b* in an open state. In this case, the two connectors 2, 4 are not electrically interconnected either by means of the connecting element 8 or by means of the resistor element 18.

Figure 5A:
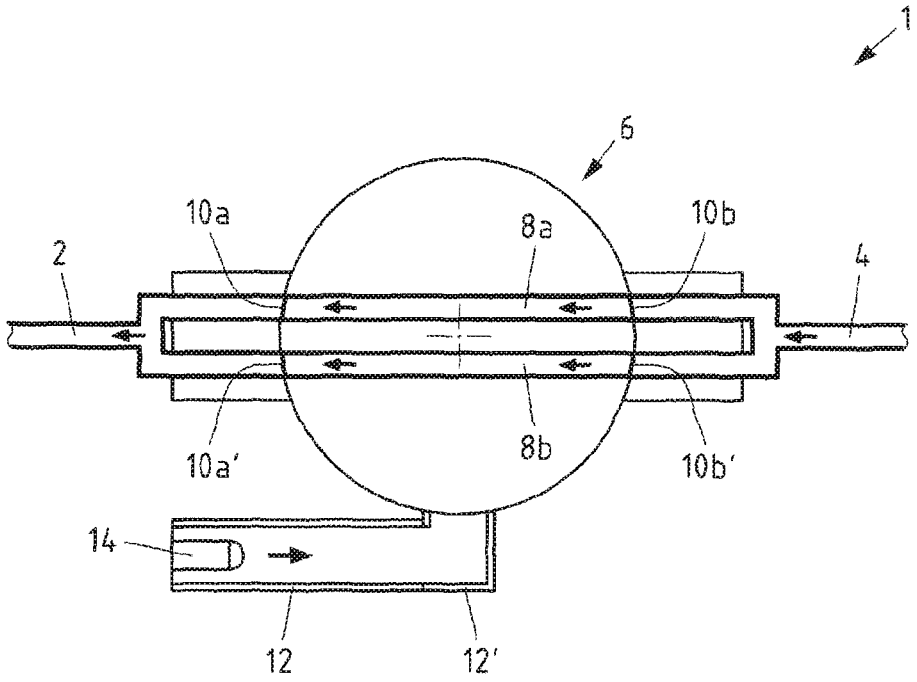
FIG. 5*a* shows a disconnecting device for a power line in a parallel arrangement according to a first embodiment in a closed state.

FIG. 5*a, b* show a disconnecting device for a power line 1 in a parallel arrangement according to a first embodiment.

FIG. 5*a* shows a structure having a rotatable, circular disconnecting means 6 in a closed state. According to this embodiment, a first and a second connector 2, 4 are electrically interconnected by means of two connecting elements 8*a, b* at a first and second contact point 10*a*, 10*a'* and a third and fourth contact point 10*b*, 10*b'*. The connecting elements 8*a, b* are arranged on the disconnecting means 6. Similarly to the embodiment according to FIG. 1*a, b*, a connection lug 12' is fastened to the disconnecting means 6, which lug is arranged at an ignition channel 12 comprising an ignition squib 14.

The connecting elements 8*a, b* can preferably be in the form of flat conductors. However, it is understood that the connecting elements 8*a, b* can also be in the form of round conductors. Preferably, the connecting elements 8*a, b* can be oriented substantially parallel to one another and have substantially the same length and the same cross section. In addition, the two connecting elements 8*a, b* can advantageously be formed from the same material.

Figure 5B:
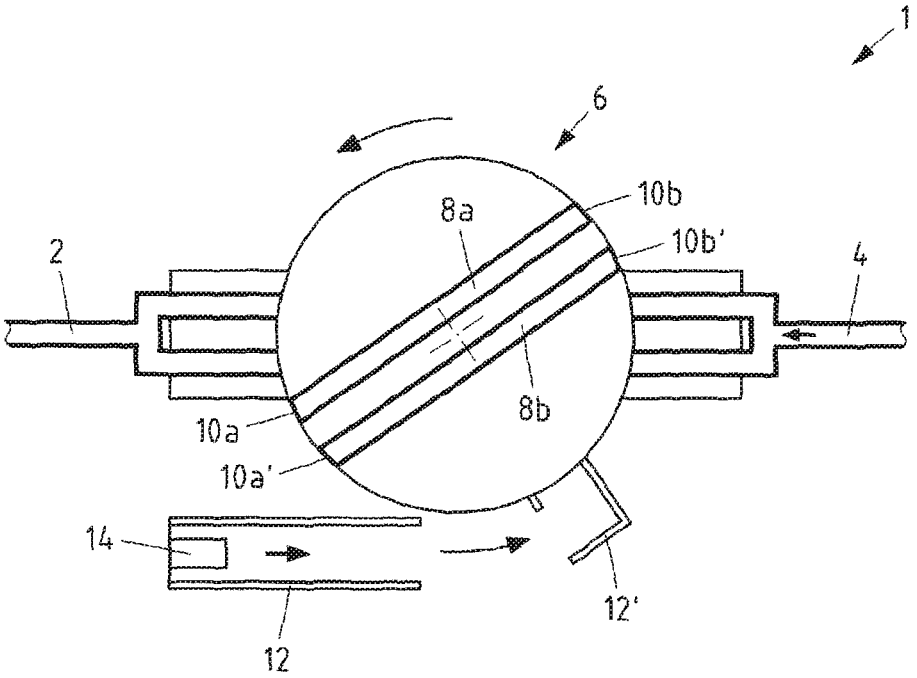
FIG. 5*b* shows the disconnecting device according to FIG. 5*a* in an open state.

FIG. 5*b* shows a disconnecting device for a power line 1 according to FIG. 5*a* in an open state. In this case, the two connectors 2, 4 are no longer interconnected by means of the connecting elements 8*a, b*, but rather are disconnected from one another as a result of a rotation of the disconnecting means 6. According to the embodiments from FIG. 1*a, b*, in this case as well, the connection lug 12' was disconnected from the ignition channel 12 by the triggering of the ignition squib 14, as a result of which the disconnecting means 6 can no longer be held in the original position thereof. By means of the rotation shown of the disconnecting means 6 by an angle of approx. 20-25° anticlockwise, the connecting elements 8*a, b* are disconnected substantially simultaneously from the first and second connectors 2, 4 at the first and second contact points 10*a*, 10*a'* and the third and fourth contact points 10*b*, 10*b'*.

With the embodiment shown in FIG. 5*a, b*, it is not only possible to disconnect, substantially simultaneously, the current path at two different contact points 10*a*, 10*b* which are arranged at a distance from one another, but by means of the parallel arrangement of the connecting elements 8*a, b* it is additionally made possible to disconnect, substantially simultaneously, at two further disconnecting points which are each arranged parallel to the first two disconnecting points. Thus, not only can the induced voltage be divided between two disconnecting points, but the current that flows through the disconnecting points can also additionally be halved. Consequently, the current to be switched is only half as great as in the series arrangement from FIG. 1*a, b* or 2*a, b*, which further reduces the probability of electric arcs being formed during the disconnection of a current-carrying line. The parallel arrangement having circular disconnecting means according to FIG. 5*a, b* can additionally be configured according to the configuration comprising two-part disconnecting means according to FIG. 1*c, d*, as a result of which the probability of electric arcs being formed during the disconnection of a current-carrying line can be further reduced.

Figure 6A:
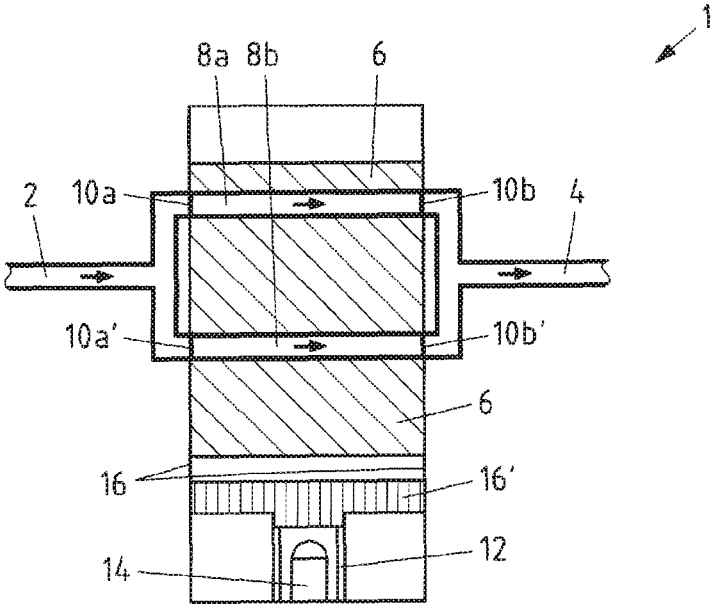
FIG. 6*a* shows a disconnecting device for a power line in a parallel arrangement according to a second embodiment in a closed state.

FIG. 6*a* shows a structure of a disconnecting device for a power line 1 in a parallel arrangement and a rectangular disconnecting means 6 in a closed state. According to this embodiment, a first and a second connector 2, 4 are electrically interconnected by means of two connecting elements 8*a, b* at a first and second contact point 10*a*, 10*a'* and a third and fourth contact point 10*b*, 10*b'*. The connecting elements 8*a, b* are arranged on the disconnecting means 6.

Figure 6B:
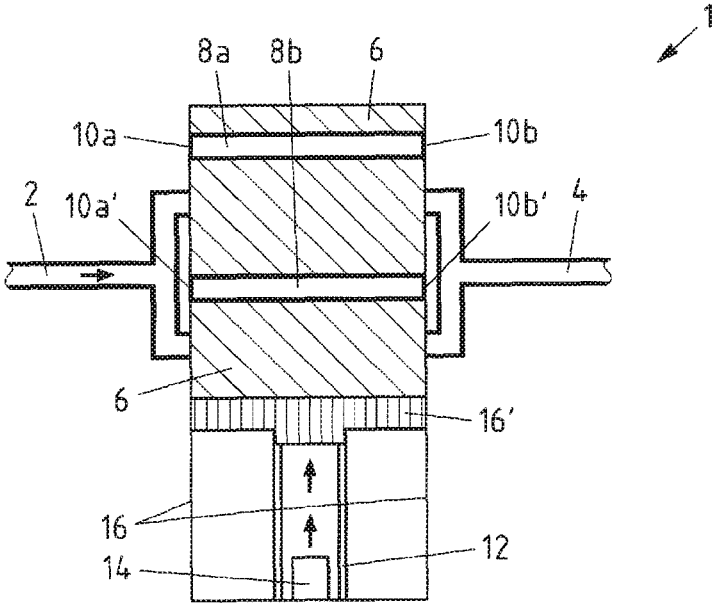
FIG. 6*b* shows the disconnecting device according to FIG. 6*a* in an open state.

FIG. 6*b* shows the arrangement from FIG. 6*a* in an open state. In this case, the two connectors 2, 4 are now no longer interconnected by means of the connecting elements 8*a, b*, but rather are disconnected from one another as a result of a translational movement of the disconnecting means 6 substantially perpendicularly to the connection axis of the connectors and the connecting element. In this case as well, the translational movement of the disconnecting means 6 takes place by means of an acceleration of the pin 16' as a result of a triggering of the ignition squib 14. By means of the translational movement shown of the disconnecting means 6, the connecting element is disconnected substantially simultaneously from the first and second connectors 2, 4 at the first and second contact points 10*a*, 10*b* and a third and fourth contact points 10*b*, 10*b'*.

Figure 7A:
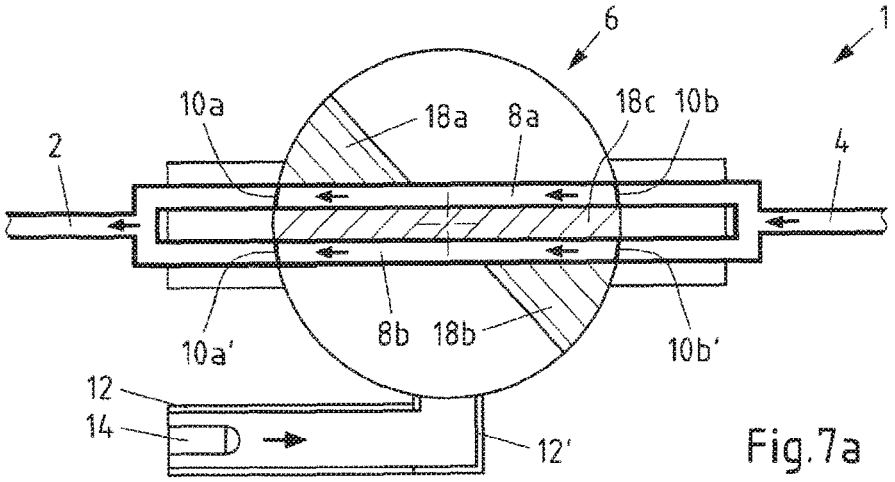
FIG. 7*a* shows a disconnecting device for a power line in a parallel arrangement and a two-stage configuration according to a first embodiment in a closed state.
Figure 7B:
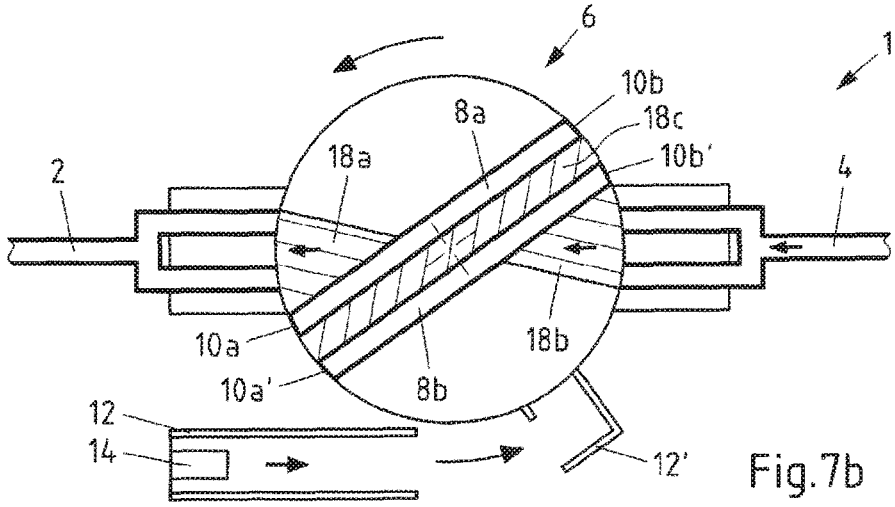
FIG. 7*b* shows the disconnecting device according to FIG. 7*a* in a state immediately after the disconnection.
Figure 7C:
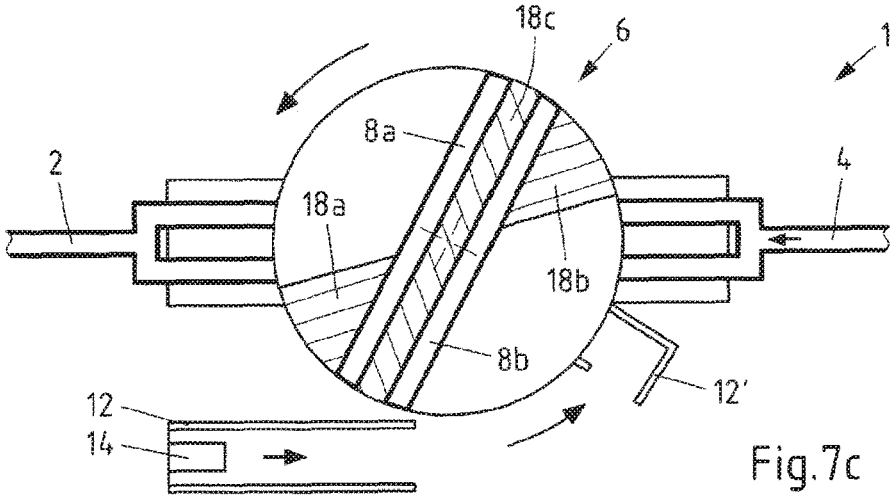
FIG. 7*c* shows the disconnecting device according to FIG. 7*a, b* in an open state.

FIG. 7*a-c* show a disconnecting device for a power line 1 in a parallel arrangement and a two-stage configuration according to a first embodiment.

FIG. 7*a* shows a closed state in which a first and second connector 2, 4 are electrically interconnected by means of two connecting elements 8*a, b* at a first and second contact point 10*a*, 10*a'* and at a third and fourth contact point 10*b*, 10*b'*. The connecting elements are arranged on a rotatable, circular disconnecting means 6. In addition, the disconnecting device 1 comprises the resistor elements 18*a, b* which are arranged in a partly circular shape on the disconnecting means 6. In addition to the resistor elements which are arranged in a partly circular shape on the disconnecting means, in this embodiment, the disconnecting device also comprises a third resistor element 18*c* which is arranged between the two connecting elements 8*a, b*.

FIG. 7*b* shows a state between a closed state of the disconnecting device 1 according to FIG. 7*a* and an open state according to FIG. 7*c* immediately after the disconnection of the connectors 2, 4 from the connecting elements 8*a, b*. In this case, the two connectors 2, 4 are now no longer electrically interconnected by means of the connecting elements 8*a, b*, but rather are now electrically interconnected at least in part by means of the resistor elements 18*a, b, c* as a result of a rotation of the disconnecting means 6. The rotation of the disconnecting means 6 takes place—as can be seen from FIG. 7*b*—by the triggering of an ignition squib 14 and the related disconnection of the connection lug 12' from the ignition channel 12. As a result of the rotation shown of the disconnecting means 6 by an angle of approx. 10-15° anticlockwise, the connecting elements 8*a, b* were disconnected from the first and second connectors 2, 4 at the first and second contact points 10*a*, 10*b* and at a third and fourth contact point 10*b*, 10*b'*, wherein an electrical connection is formed between the first and second connectors at least in part by means of the resistor elements 18*a, b, c*.

FIG. 7*c* shows the disconnecting device for a power line 1 according to FIG. 7*b* after a further or the continuation of a rotation by an angle of a further approx. 10-15° in an open state. In this case, the two connectors 2, 4 are now not electrically connected either by means of the connecting elements 8*a, b*, or at least in part by means of the resistor elements 18*a, b, c*.

By means of the combination shown in FIG. 7*a-c* of a series disconnection, a parallel disconnection and a reduction in the current gradient, the probability of electric arcs being formed can be further reduced by comparison with the previous embodiments. The combination of a series and a parallel disconnection according to FIG. 7*a-c* can also be further developed according to the configuration with two-part disconnecting means according to FIG. 1*c, d*, by means of which the probability of electric arcs being formed during the disconnection of a current-carrying line can be further reduced.

Figure 8A:
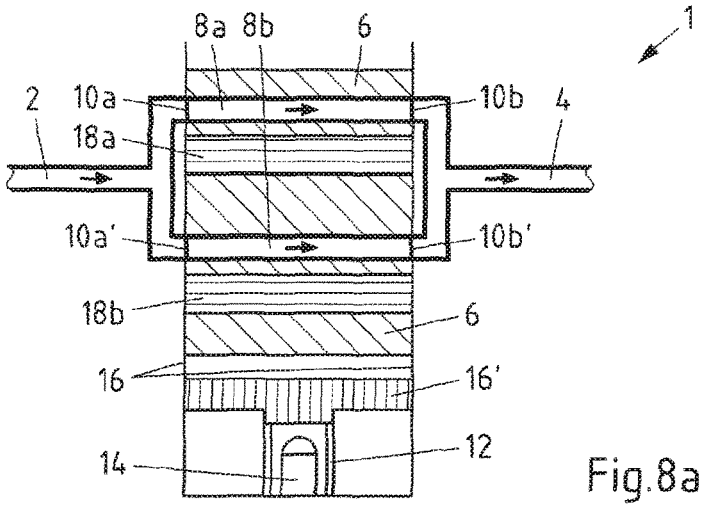
FIG. 8*a* shows a disconnecting device for a power line in a parallel arrangement and a two-stage configuration according to a second embodiment in a closed state.
Figure 8B:
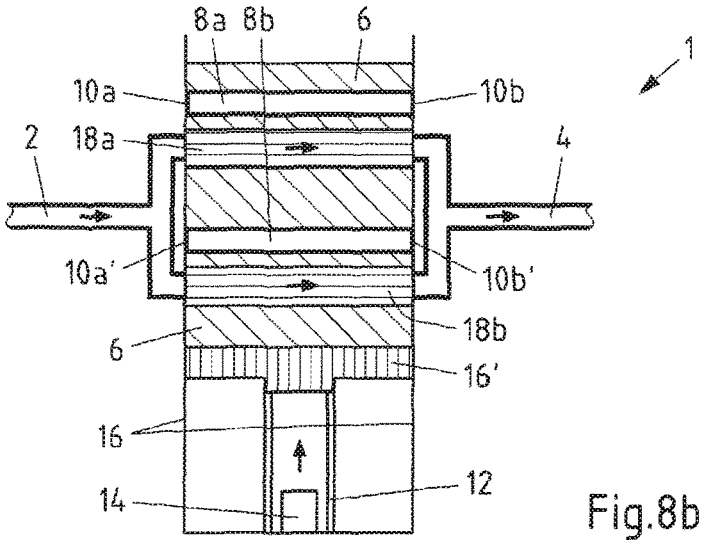
FIG. 8*b* shows the disconnecting device according to FIG. 8*a* in a state immediately after the disconnection.
Figure 8C:
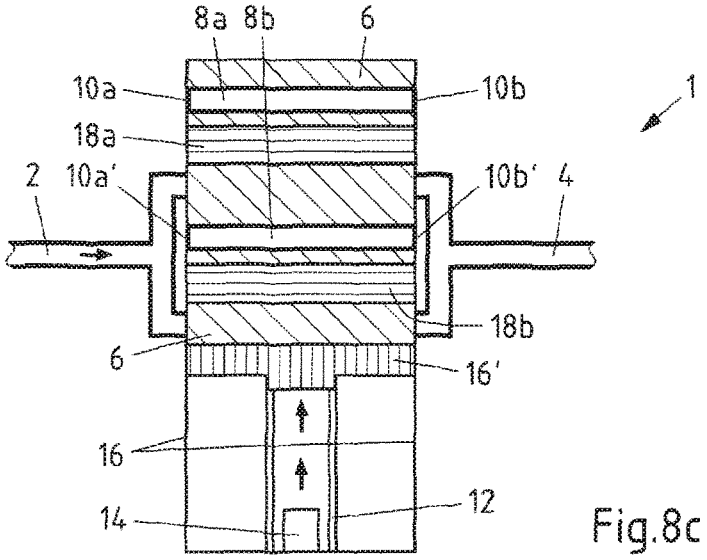
FIG. 8*c* shows the disconnecting device according to FIG. 8*a, b* in an open state.

FIG. 8*a-c* show a disconnecting device for a power line 1 in a parallel arrangement and a multi-stage disconnection according to a second embodiment.

FIG. 8*a* shows a closed state in which a first and second connector 2, 4 are electrically connected by means of two connecting elements 8*a, b* at a first and second contact point 10*a*, 10*a'* and at a third and fourth contact point 10*b*, 10*b'*. The connecting elements are arranged on a preferably rectangular disconnecting means 6. In addition, the disconnecting device 1 comprises at least two resistor elements 18*a, b* which, in addition to the connecting elements 8*a, b*, are arranged on the disconnecting means 6.

FIG. 8*b* shows a state between a closed state of the disconnecting device 1 according to FIG. 8*a* and an open state according to FIG. 8*c* immediately after the disconnection of the connectors 2, 4 from the connecting elements 8*a, b*. In this case, the two connectors 2, 4 are now no longer electrically interconnected by means of the connecting elements 8*a, b*, but rather are now electrically interconnected at least in part by means of the resistor elements 18*a, b* as a result of a translational movement of the disconnecting means 6. The translational movement of the disconnecting means 6 takes place—as can be seen from FIG. 8*b*—by the triggering of an ignition squib 14 and the related acceleration of a pin 16' away from the ignition channel 12. As a result of the translational movement shown of the disconnecting means 6, the connecting elements 8*a, b* are disconnected from the first and second connectors 2, 4 at the first and second contact points 10*a*, 10*b* and at a third and fourth contact point 10*b*, 10*b'*, an electrical connection being formed between the first and second connectors at least in part by means of the resistor elements 18*a, b*.

FIG. 8*c* shows the disconnecting device for a power line 1 according to FIGS. 8*a* and *b* in an open state. In this case, the translational movement of the disconnecting means 6 is further advanced so that the two connectors 2, 4 are now not electrically connected either by means of the connecting elements 8*a, b* or by means of the resistor elements 18*a, b*.

Figure 9A:
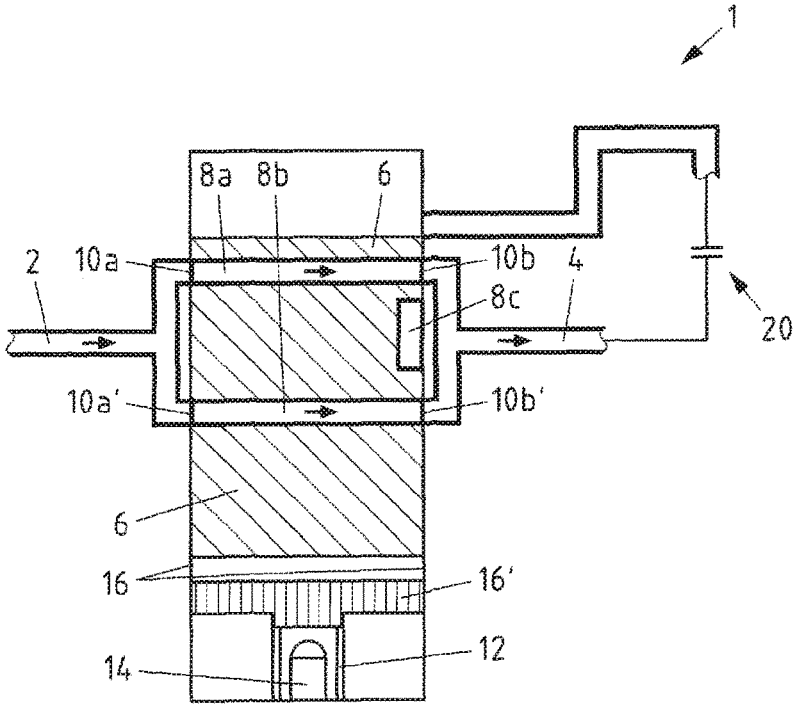
FIG. 9*a* shows a disconnecting device for a power line for the simultaneous disconnection and production of an electrical connection according to a first embodiment in an initial state.

Furthermore, FIG. 9*a, b* show a disconnecting device for a power line 1 for simultaneously disconnecting and producing an electrical connection according to another embodiment.

FIG. 9*a* shows the disconnecting device 1 in an initial state in which a first electric circuit is closed and a second electric circuit is open. The first electric circuit is shown by way of example in the form of a parallel arrangement having a disconnecting means 6. According to this embodiment, in the first electric circuit, a first and a second connector 2, 4 are electrically interconnected by means of two connecting elements 8*a, b* at a first and second contact point 10*a*, 10*a'* and a third and fourth contact point 10*b*, 10*b'*. In addition to the connecting elements 8*a, b*, a third connecting element 8*c* is also arranged on the disconnecting means 6, which element is not electrically connected to either of the two electric circuits. By contrast, the first and second electric circuits are electrically connected by means of a capacitor 20. Furthermore, the disconnecting device 1 comprises a pin 16' which is arranged between a disconnecting means 6 and an ignition channel 12 comprising an ignition squib 14.

Figure 9B:
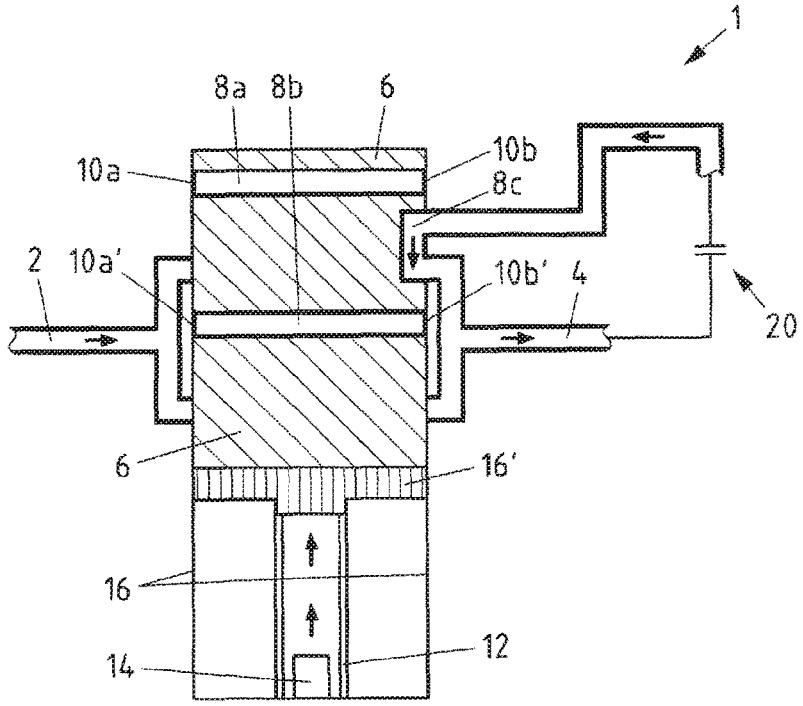
FIG. 9*b* shows the disconnecting device according to FIG. 9*a* in a final state.

FIG. 9*b* lastly shows the disconnecting device 1 according to FIG. 9*a* in a final state. In this case, a first electric circuit is now in an open state, and a second electric circuit is in a closed state. Accordingly, the two connectors 2, 4 in the first electric circuit are now no longer interconnected by means of the connecting elements 8*a, b*, but rather are disconnected from one another as a result of a translational movement of the disconnecting means 6, preferably perpendicularly to the connection axis of the connectors and the connecting elements 8*a, b*. In this case as well, the translational movement of the disconnecting means 6 takes place by means of an acceleration of the pin 16' as a result of a triggering of the ignition squib 14. By means of the translational movement shown of the disconnecting means 6, the connecting elements 8*a, b* are disconnected substantially simultaneously from the first and second connectors 2, 4 at the first and second contact points 10*a*, 10*b* and a third and fourth contact point 10*b*, 10*b'*.

In addition, to disconnect the connecting elements from the first and second connectors in the first electric circuit, the third connecting element 8*c* is shifted by the movement in such a way that it produces an electrical connection between the second connector and the second electric circuit at substantially the same time. Thus, according to the final state—as can be seen from FIG. 9*b*—the first electric circuit is in an open state, and the second electric circuit is in a closed state.

By means of the embodiment shown in FIGS. 9*a* and *b*, it can be possible for example, in addition to disconnecting a current-carrying line, to also safely discharge the electrical energy stored in an intermediate electric circuit in order to prevent people being at risk as a result of high voltage. Intermediate electric circuits operated under high voltage are frequently used in high-voltage applications such as electric or hybrid vehicles.

It is understood that a disconnecting device for a power line 1 for simultaneously disconnecting and producing an electrical connection can likewise be formed by means of a combination of a second electric current with any other embodiment of one of the disconnecting devices presented here, provided that, in an initial state, one of the two electric circuits is closed, whereas the other electric circuit is open, and in a subsequent final state, the previously open electric circuit is closed, whereas the previously closed electric circuit is now in an open state.

The invention claimed is:

1. A disconnecting device for a power line, the disconnecting device comprising:

at least one disconnecting means which is spatially arranged between a first connector and a second connector when the disconnecting device is in a closed state, the at least one disconnecting means being movable between a closed position and an open position, and having at least one connecting element forming an electrical connection between the first and second connectors when the disconnecting device is in the closed state, wherein the at least one connecting element is electrically connected to the first connector via a first contact point and to the second connector via a second contact point when the disconnecting device is in the closed state, wherein the at least one disconnecting means is arranged in such a way that a breakdown voltage between the first connector and the second connector when the disconnecting device is in an open state is greater than the breakdown voltage between at least one of the first connector and the first contact point of the at least one connecting element and the second connector and the second contact point of the at least one connecting element, wherein the at least one disconnecting means is coated with at least two resistor elements which have different specific conductivities and form a resistance gradient, and wherein the at least two resistor elements, immediately after disconnection, are arranged between the first and second connectors, thereby electrically connecting the first and second connectors.

2. The disconnecting device according to claim 1, wherein the at least one connecting element is arranged on the at least one disconnecting means in such a way that a disconnection takes place at at least two contact points at substantially the same time.

3. The disconnecting device according to claim 1, wherein the at least one disconnecting means is movable between an open state and the closed state of the disconnecting device in at least one of a translational manner and a rotational manner.

4. The disconnecting device according to claim 1, wherein the at least one disconnecting means comprises a catch tab which holds the at least one disconnecting means in position when the disconnecting device is in the closed state.

5. The disconnecting device according to claim 1, wherein the at least one disconnecting means is controlled by compressed air.

6. The disconnecting device according to claim 1, wherein, in a final state of the disconnecting device, the at least one disconnecting means is arranged in such a way that the breakdown voltage between the first connector and the second connector is the same as or less than the breakdown voltage between at least one of the first connector and the first contact point of the at least one connecting element and the second connector and the second contact point of the at least one connecting element.

7. The disconnecting device according to claim 1, wherein the at least one disconnecting means comprises at least one isolation element which is spatially arranged between the first connector and the second connector when the disconnecting device is in an open state.

8. The disconnecting device according to claim 7, wherein the at least one isolation element is formed from an isolation material having a dielectric strength of more than 5 kV/mm.

9. The disconnecting device according to claim 7, wherein the at least one isolation element is formed from an isolation material having a specific electric conductivity of less than $10^{-5}$ $S \cdot cm^{-1}$.

10. The disconnecting device according to claim 1, wherein the at least two resistor elements are formed from a material having a specific electric conductivity of less than $10^{2}$ $S \cdot cm^{-1}$.

11. The disconnecting device according to claim 1, wherein the disconnecting device comprises at least two disconnecting means electrically connected in series, and wherein the at least two disconnecting means are spatially separated from one another.

12. A method for disconnecting a power line, the method comprising:

receiving at least one disconnecting signal, triggering at least one control signal in such a way that an electrical connection between a connecting element arranged on a disconnecting means and a first connector at a first contact point and an electrical connection between the connecting element and a second connector at a second contact point is disconnected by the movement of the disconnecting means from a closed position to an open position in such a way that a breakdown voltage between the first connector and the second connector when the disconnecting device is in a disconnected state is greater than the breakdown voltage between at least one of the first connector and the first contact point of the connecting element and the second connector and the second contact point of the connecting element, wherein the disconnecting means is coated with at least two resistor elements, wherein the at least two resistor elements have different specific conductivities and form a resistance gradient, and wherein the at least two resistor elements are arranged between the first connector and the second connector immediately after disconnection.

13. The method for disconnecting a power line according to claim 12, wherein, in addition to a disconnection of the electrical connection, at substantially the same time as the disconnection of the electrical connection, a second electrical connection is produced to discharge stored electrical energy.

* * * * *